US006971585B2

(12) United States Patent
Johnson et al.

(10) Patent No.: US 6,971,585 B2
(45) Date of Patent: Dec. 6, 2005

(54) SYSTEM AND METHOD FOR PROTECTING EQUIPMENT FROM DAMAGE DUE TO LOW OR RAPIDLY CHANGING TEMPERATURES

(75) Inventors: Roy P. Johnson, Wappingers Falls, NY (US); Alan J. Orndorff, Walden, NY (US)

(73) Assignee: International Business Machines Corporation, Armonk, NY (US)

( * ) Notice: Subject to any disclaimer, the term of this patent is extended or adjusted under 35 U.S.C. 154(b) by 187 days.

(21) Appl. No.: 10/713,346

(22) Filed: Nov. 13, 2003

(65) Prior Publication Data

US 2005/0121533 A1 Jun. 9, 2005

(51) Int. Cl.[7] ..... B60H 1/02
(52) U.S. Cl. ..... 237/12.1; 60/624
(58) Field of Search ..... 237/12.1, 2 A; 60/39.01, 793, 624

(56) References Cited

U.S. PATENT DOCUMENTS

| | | | | |
|---|---|---|---|---|
| 2,051,240 | A * | 8/1936 | Berryman | 290/2 |
| 4,065,055 | A * | 12/1977 | De Cosimo | 237/12.1 |
| 4,164,660 | A * | 8/1979 | Palazzetti | 290/2 |
| 4,201,058 | A * | 5/1980 | Vaughan | 60/618 |
| 4,264,826 | A * | 4/1981 | Ullmann | 290/2 |
| 4,309,877 | A | 1/1982 | Tawse | |
| 4,686,378 | A | 8/1987 | Sisk | |
| 5,819,843 | A * | 10/1998 | Inoue et al. | 165/219 |
| 6,290,142 | B1 * | 9/2001 | Togawa et al. | 237/12.1 |

FOREIGN PATENT DOCUMENTS

| | | |
|---|---|---|
| JP | 6137254 A | 5/1994 |
| JP | 11014186 A | 1/1999 |
| JP | 2002310452 | 10/2002 |

* cited by examiner

*Primary Examiner*—Derek S. Boles
(74) *Attorney, Agent, or Firm*—George R. McGuire; Bond Schoneck & King, PLLC

(57) ABSTRACT

A system and method of protecting production tooling used in semiconductor fabrication from potentially damaging low temperatures or sudden temperature drops during periods of primary power outage and low outside temperatures. The boilers and pumps at a central utility plant (CUP) which normally provide superheated water under pressure to heat exchangers in each building to be heated are cut back to a fraction of their normal heating capacity during periods of primary power outage, although air continues to be exhausted from, and outside air taken into fabrication buildings. In the present invention, an additional heat exchanger is placed in each building which houses production tooling, and the coolant from the engine used to drive the generator for powering the air handling equipment in the building may be selectively directed through one of the flow paths of the second heat exchanger. Water which circulates through the building heater(s) to heat the air entering the building passes through the first heat exchanger, picking up heat from the water heated at the CUP, after passing through the second heat exchanger, picking up heat from the engine coolant. This augmentation of the heat provided to the fabrication areas during periods of primary power outage and low outside temperatures prevents the aforesaid damage in all reasonably foreseeable weather conditions.

19 Claims, 2 Drawing Sheets

SYSTEM AND METHOD FOR PROTECTING EQUIPMENT FROM DAMAGE DUE TO LOW OR RAPIDLY CHANGING TEMPERATURES

BACKGROUND OF THE INVENTION

The present invention relates to back-up heating systems, and methods of operation thereof, for supplying the heat necessary to avoid damage to expensive equipment which may be caused by low temperatures and/or rapid temperature changes. More specifically, the invention relates to systems and methods of augmenting the supply of heat to enclosed areas, particularly those containing expensive, heat-sensitive production equipment, such as that used in the production of semiconductor components and circuits, in the event of failure of the primary power supply during periods of low outdoor temperatures.

In many production facilities, several buildings are located about a campus which includes a central utility plant (hereinafter denoted CUP) having gas/oil fired boilers and large, electrically powered pumps for providing, when outside temperatures require, space heating to the fabrication buildings and possibly to office and other buildings as well. In typical systems, the buildings are heated by hot water heaters or radiators, the water being heated by circulating through one flow path of a heat exchanger with boiler-heated water circulating through the other flow path. In the event of a power outage, i.e., a cessation of electrical power received by the equipment at the CUP which relies upon such power for supplying heat, back-up means must be provided for supplying at least some of the necessary space heating. Such back-up means commonly takes the form of a gasoline or diesel fueled engine which drives a generator at the CUP to provide the electricity used to power pumps and other emergency equipment to circulate heated water to the building heat exchangers.

Building codes commonly require that buildings containing semiconductor fabrication equipment have an air exhaust system, with the consequent necessity of taking in outside air in a quantity sufficient to replace the exhaust air. The exhaust fans and intake air handing systems are also electrically powered, with a separate motor/generator provided in each building to supply the required power during periods of primary electrical supply outages. Upon the occurrence of a power outage, both the exhaust and make-up air handling systems are, in typical systems, ramped down to 50% of their flow under normal conditions, thereby satisfying code requirements. However, regardless of the degree of thermal integrity (insulation) of the building, significant amounts of outside air, which may be very cold, must still enter the building on a continuous basis. Although the motor/generator at the CUP will supply electricity to power pumps sufficient to circulate hot water to provide enough heat to the incoming air as to prevent the temperature in fabrication areas from reaching the freezing mark, the temperature may fall to a point, or the rate of temperature change may be so rapid, as to cause permanent damage to elements of the production equipment, such as lenses of photolithography equipment used in semiconductor fabrication. When this occurs, not only is there the expense of purchasing and installing new components to replace those damaged, but the much greater expense of lost production time while the equipment is out of service.

The conventional approach to the problem outlined above has taken one of two forms: 1. expand the emergency power generation system in the CUP by providing larger and/or additional engine/generators or 2. provide a local boiler, connected to the building emergency power generation system, in each building requiring supplemental heat. Both approaches involve high initial expense and ongoing maintenance, in addition to requiring significant space, possibly involving expansion of existing buildings.

The principal object of the present invention is to provide a simple, relatively inexpensive, yet durable and reliable system and method for protecting expensive fabrication equipment from damage due to low temperature and/or to rapid temperature change.

Another object is to provide a novel and improved system and method, operable in the event of interruption in the primary electrical power supply under conditions of low outside temperatures, for adding heat to air entering an enclosed space in excess of the heat provided by a conventional, back-up heating system including an engine and generator.

A further object is to provide a unique and efficient system and method of utilizing heat energy generated by an internal combustion engine driving an electrical generator in providing, under conditions of low outside temperatures, heat to enclosed spaces containing production equipment which is subject to damage by low temperatures and/or by rapid temperature changes.

Other objects will in part be obvious and will in part appear hereinafter.

SUMMARY OF THE INVENTION

The present invention is emloyed in a production facility comprising a plurality of buildings, at least some of which house semiconductor fabrication tooling, and a CUP containing, among other equipment, fluid-fired boilers, each with an associated, electrically powered pump, the combined boiler and pump being referred to collectively as a "boiler system." The boiler systems supply hot water used, when outside air is below a predetermined temperature, to provide heat to areas in the fabrication buildings containing production equipment. The primary electrical power source for pump operation is the usual, commercial supply from the local public utility, or the like. In the event of a power outage, i.e., interruption of power from the primary supply, at least one of the boiler systems operates on electrical power from a back-up source comprising a generator driven by a diesel or gasoline fueled, internal combustion engine. A separate motor/generator system is located in each of the fabrication buildings to operate the air handling system during periods of primary power outage, and includes the usual, heat-rejecting radiator, normally located outside the building, through which engine coolant is circulated.

In the system of the present invention, a second heat exchanger, having two, mutually exclusive, liquid flow paths, is provided in each fabrication building, in addition to the conventional heat exchanger mentioned earlier. During periods of primary power outage when outside temperature is below the value requiring heating of the fabrication buildings, liquid coolant from the motor/generator in the fabrication building is diverted, through operation of a three-way valve, from the radiator to one of the flow paths through the second heat exchanger. The heating water supply from the CUP passes through one flow path of the conventional (first) heat exchanger in the fabrication building, transferring heat to the water circulating through the other flow path and the heater. Rather than circulating directly from the heater back to the first heat exchanger, the heated water is diverted, through operation of a second three-way valve and booster pump, through the other flow path of the second heat exchanger to receive heat from the engine coolant therein, thereby providing additional heat to the area containing the production tooling. Preferably, the space heaters are located in the intake of the make-up air which is introduced from the outside to compensate for air which is exhausted from the production equipment. This augmentation of the temperature in the fabrication areas serves to prevent damage which could otherwise be incurred by equipment which is sensitive to rapid temperature changes.

The foregoing and other features of construction and operation of the invention will be more readily understood and fully appreciated from the following detailed disclosure, taken in conjunction with the accompanying drawings.

For greater clarity throughout the Figures, lines carrying heating water to and from the various buildings and elements therein are shown in solid lines, and electrical lines are shown as long and short dashed lines.

DETAILED DESCRIPTION

Figure 1:
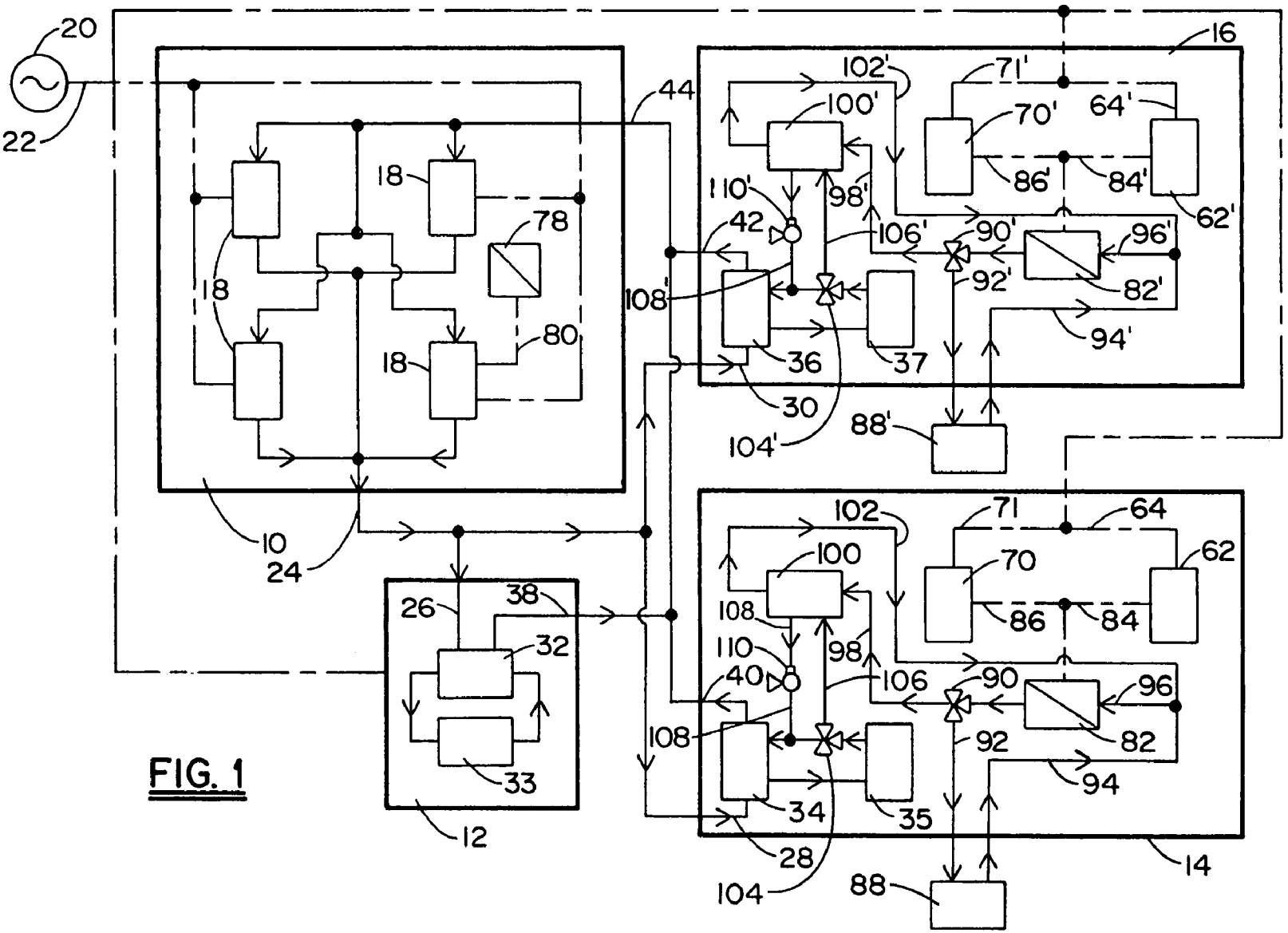
FIG. 1 is a diagrammatic illustration of a manufacturing facility comprising multiple buildings and illustrating the flow of water for heating purposes to the various buildings, as well as the flow of electricity from both primary and secondary supplies to electrically powered equipment.

In FIG. 1, block 10 represents a central utility plant (CUP), i.e., a building containing, among other things, the apparatus for supplying heat, in the form of hot water, to office building 12 and semiconductor fabrication buildings 14 and 16. A plurality of boiler systems 18 each include a fluid fired boiler and large, circulation pump receiving electrical power from a remote, commercial supply 20 over line 22. Water is heated in boiler systems 18 to a predetermined temperature and is circulated by the pumps through hot water supply line 24 and is supplied through lines 26, 28, and 30 to a first flow path of each of conventional hot water heat exchangers 32, 34 and 36 within buildings 12, 14 and 16, respectively. After transferring heat to the water within the second flow path of heat exchangers 32, 34 and 36, the boiler-heated water is returned through lines 38, 40 and 42 from buildings 12, 14 and 16, respectively, to return line 44 and thence to boiler systems 18 for re-heating. Water receiving heat from exchangers 32. 34 and 36 is circulated to space heaters 33, 35 and 37, respectively.

Figure 2:
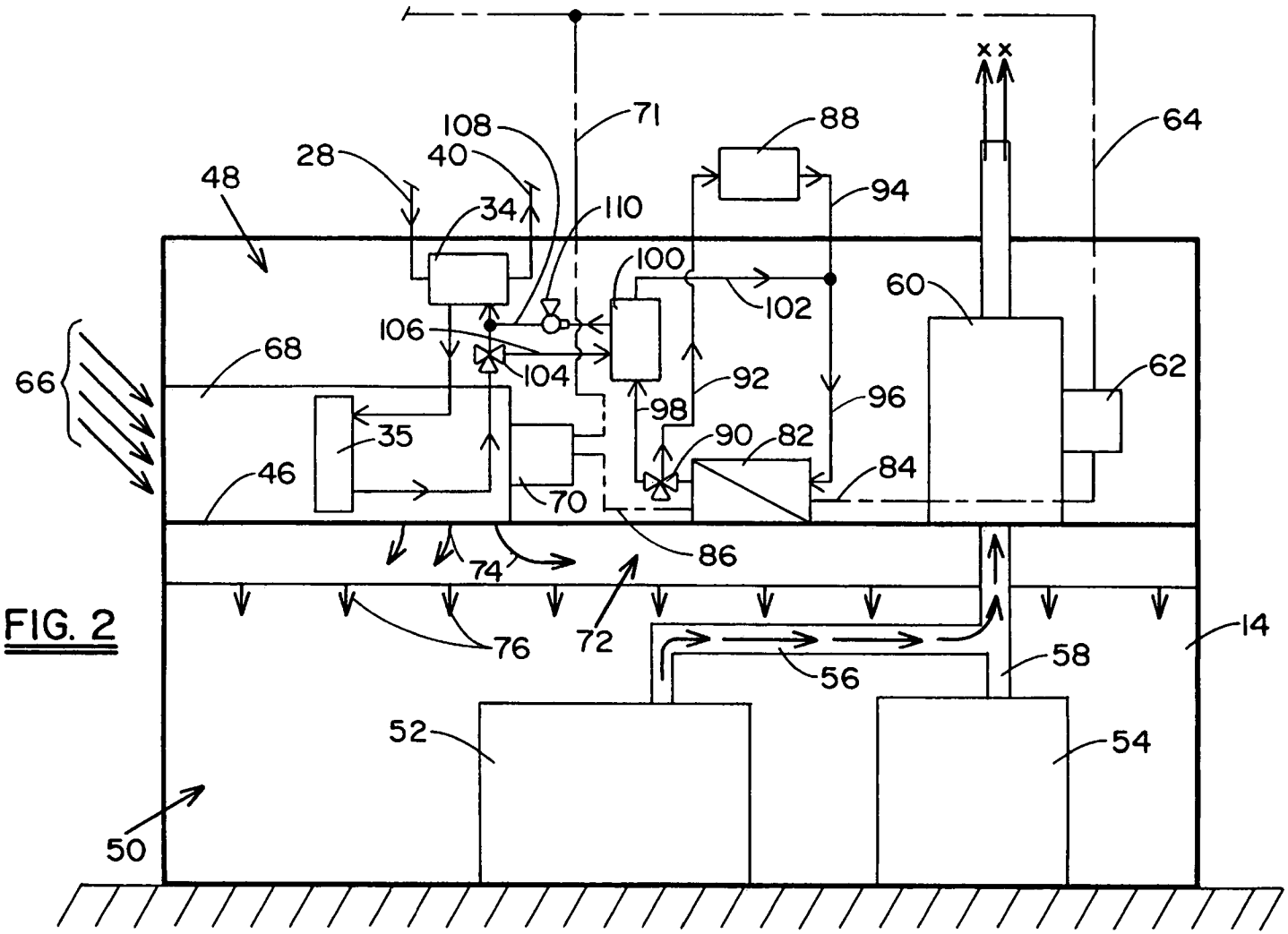
FIG. 2 is a diagrammatic, front elevation of one of the buildings of FIG. 1.

FIG. 2 diagrammatically illustrates, in front elevation, a semiconductor fabrication building 14 having structural features and other elements in common with building 16. The building is divided by solid barrier 46 into upper and lower compartments 48 and 50, respectively. Fabrication of semiconductor components, chips, circuits, and the like, is performed, at least partially, by production tools, denoted generally by reference numerals 52 and 54, in lower compartment 50. Tools 52 and 54 are of a conventional form which includes components, e.g., lenses used in photolithography equipment, which are subject to damage or destruction when subjected to low and/or rapidly changing temperatures. Such equipment requires an exhaust system and a constant supply of fresh, clean air to replace that which is exhausted. In the illustrated system, air is exhausted from tools 52 and 54 through ducts 56 and 58, respectively, and is moved by exhaust fans or blowers within enclosure 60, which may also contain any necessary air treatment equipment, in upper compartment 48 to outside atmosphere. The exhaust fans are driven by an electric motor, indicated by the block numbered 62, powered by electricity from source 20 through line 64.

An amount of air substantially equal to that exhausted from the building must be taken in from outside atmosphere. This is accomplished by providing air intake openings through which atmospheric air, indicated by arrows 66, is passed to air treatment enclosure 68 in upper compartment 48. Intake fans within enclosure 68 are powered by an electric motor 70 powered by electricity from source 20 on line 71. When heating is required, the air passing through enclosure 68 is heated by the previously mentioned hot water heater 35. The line through which water is supplied from boiler system 18 to heat exchanger 34 is numbered 28, and the return line 40, corresponding to their numbering in FIG. 1. Essentially all particulate matter down to sub-micron size is removed by filters in enclosure 68 and the air is heated by the hot water heater 35 before being delivered to plenum 72 in the upper part of lower compartment 50, as indicated by arrows 74. Air from plenum 72 passes vertically downward, in laminar fashion, into lower compartment 50, as shown by the arrows numbered 76, and maintains both the pressure and temperature therein within a desired range.

In the event of failure or interruption of electrical power from source 20 for any reason during periods when heat is required for the various buildings, it is common practice to immediately commence operation of auxiliary generators, driven by an internal combustion engine to provide the electricity needed to continue operation of one of boiler systems 18. Engine/generator 78 are shown in FIG. 1 within CUP 10, supplying electricity on line 80 to the circulating pump for the heated water in one of boiler systems 18, which becomes the single, operative boiler system, providing heating water through line 24 and receiving return water through line 44. Although fabrication operations are normally suspended during periods of primary power outages, it is still a requirement (e.g., by building codes) that air intake and exhaust continue to operate in fabrication buildings. The volume of air per unit of time, usually expressed in terms of cubic feet or cubic meters per minute, may be, and normally is, reduced to 50% of the volume handled during normal operation, but in a typical fabrication building this may still represent 500,000 cfm. Electricity for operating the air intake and exhaust systems, and often to maintain production tooling in a stand-by condition, is conventionally provided by an engine/generator set in each fabrication building.

Common reference numerals are used in FIG. 2 to denote the elements in building 14 which are also shown in FIG. 1, while the corresponding elements in building 16 are noted by the same reference numerals with a prime sign (') added. Engine/generators 82, 82' are provided in buildings 14 and 16, respectively, to provide the electricity necessary to operate motors 62, 62' and 70, 70' in the event of power failure at source 20. Electricity to motors 62, 62' is provided on lines 84, 84', respectively, and that for motors 70, 70' is provided on lines 86, 86', respectively. Liquid coolant used in engine/generators 82, 82' is normally circulated to conventional radiators and the heat rejected to outside air before return to the respective engine/generator. The outdoor radiators for engine/generators 82, 82' are shown in FIG. 1, denoted by reference numerals 88, 88', respectively.

All of the foregoing conforms to conventional practice. The use of a single boiler at the CUP will, under virtually all reasonably anticipated circumstances, provide sufficient heat to the various buildings to maintain inside temperatures above the freezing point, even with the intake and exhaust systems in the fabrication buildings operating at 50% of normal capacity. However, this amount of heat alone may not be sufficient to prevent damage to temperature-sensitive elements of the production tooling. Traditional means of addressing this problem have included placing more or larger engine/generators at the CUP, and providing a boiler and associated pumps, driven by an additional engine generator, in each fabrication building. Both approaches are very expensive and require additional space, sometimes involving expanding the CUP and/or fabrication buildings.

Structural and operational features of the present invention are explained below with reference to building 14, as shown in FIG. 2, and portions of FIG. 1. Engine/generator 82 includes a conventional liquid cooling system. Coolant leaving the engine when outside temperatures are above a predetermined value, is directed by 3-way valve 90 to line 92 and thence to outside radiator 88 where heat is rejected to outside air, and returns to the engine through lines 94 and 96. When the outside temperature is below the predetermined value, valve 92 is switched to direct coolant through line 98 to one flow path of heat exchanger 100. After passing through heat exchanger 100 the coolant is returned to the engine via lines 102 and 96. A second 3-way valve 104 is positioned in the line between space heater 35 and heat exchanger 34. During periods of primary outage and low outside temperatures, valve 104 is actuated to direct water from heater 35 through line 106 to the other flow path of heat exchanger 100, where it receives heat from the engine coolant before circulating through line 108 to heat exchanger 34. Also, booster pump 110 is provided in line 106.

When outside temperature is high enough that auxiliary heat is not required during a power outage, engine/generator 82 (and 82') operates to provide, electricity for operating the intake and exhaust air systems, and possibly to maintain production equipment in a stand-by mode, with engine coolant directed to and from the outdoor radiator(s). When outside air temperature is below the point where heat must be provided, engine/generator 78 is operated to power the pump circulating heated water from its associated boiler system 18, and both of valves 90 and 104, together with booster pump 110 are actuated. This causes heating water which has passed through heater 35 and rejected some heat to the air coming into building 14 to circulate to heat exchanger 100 where it is reheated to some extent by engine coolant passing through a separate path within the heat exchanger. The water then passes through heat exchanger 34 before circulating again through heater 35.

The foregoing explanation with reference to elements associated with building 14 apply, of course, to the corresponding elements in building 16, and any additional fabrication buildings which may be included in the production facility. The heat which is recaptured from the engine coolant is sufficient to prevent a rapid temperature drop which may damage or destroy components of production tooling such as lenses of photolithography equipment. The system is reliable and efficient, as well as significantly less expensive to provide, install, service and house than conventional systems for carrying out the same function.

What is claimed is:

1. A back-up heating system for a building having a first, enclosed compartment containing tooling for semiconductor fabrication, and a second, enclosed compartment containing electrically powered air handling equipment for constant exhaust of air from and intake of air into said first compartment, and a first, hot water heat exchanger having a first flow path, through which water heated by a boiler remote from said building is circulated, and a second flow path, through which building level heating water is circulated to absorb heat from said boiler-heated water prior to transfer, through at least one hot water radiation heater, of some of said heat to the air in said building, said back-up heating system comprising:

a) a liquid cooled, internal combustion engine and generator for generating electricity during periods of primary power outage to operate said air handling equipment;

b) a heat rejecting radiator for selective connection to receive liquid coolant from said engine, reject heat from said coolant and return said coolant to said engine when outside temperature is above said predetermined value;

c) a second heat exchanger positioned within said building and having a third flow path, for selective connection, alternatively to said radiator, for circulation of liquid coolant from said engine, and a fourth flow path, for selective connection to receive said heating water from said heater prior to circulation of said heating water through said second flow path;

d) first means selectively operable to control flow of said coolant between said radiator and said third flow path; and e) second means selectively operable to control flow of said heating water between a direct connection from said heater to said second flow path and connection to said fourth flow path and thence to said second flow path.

2. The back-up heating system of claim 1 wherein said first means comprises a first valve.

3. The back-up heating system of claim 2 where said first valve is a three-way valve selectively actuable to direct said coolant alternatively between said radiator and said third flow path.

4. The back-up heating system of claim 3 wherein said second means comprises a second valve.

5. The back-up heating system of claim 4 wherein said second valve is a three-way valve selectively actuable to direct said heating water from said heater alternatively between said second flow path and said fourth flow path.

6. The back-up heating system of claim 1 and further including a booster pump positioned said fourth flow path and said second flow path to augment flow of said heating water from said fourth flow path to said second flow path when said second means is selectively operated to direct flow of said heating water from said heater to said fourth flow path and thence to said second flow path.

7. The back-up heating system of claim 1 wherein said radiator is located outside said building to reject heat to outside air.

8. The back-up heating system of claim 1 wherein said air handling equipment and said at least one heater are located in said second building compartment.

9. In a manufacturing facility having a first building housing at least one fluid fired boiler and electrically operated pump for supplying boiler-heated water to a first flow path of a first heat exchanger in at least one other building when outside temperature is below a first predetermined value, and a first internal combustion engine powering an electrical generator to supply power for operating said pump during periods of primary power outage, said other building housing at least one hot water radiation heater with building level heating water circulated through the second flow path of said first heat exchanger to absorb heat from said boiler-heated water and through said heater, fabrication tooling which is susceptible to damage by exposure to temperature below a second, predetermined value and/or temperature drop in excess of a predetermined rate, electrically operated air handling equipment providing a constant exhaust of air from and intake of outside air into said other building, and a second, liquid cooled, internal combustion engine powering an electrical generator to provide electrical power to said air handling equipment during periods of primary power outage, a system for preventing temperature drop below said second, predetermined value and/or temperature drop in excess of said predetermined rate within said second building during periods of primary power outage when outside temperature is below said first predetermined value, said system comprising;

a) a second heat exchanger having a third flow path with a first inlet and a first outlet, and a fourth flow path with a second inlet and a second outlet;

b) first means for selectively directing liquid coolant from said second engine though said third flow path and back to said engine; and c) second means for selectively directing said heating water from said said heater to said fourth flow path prior to circulation through said second flow path and thence back to said heater.

10. The system of claim 9 and further including a heat rejecting radiator positioned outside said second building and to which the second engine coolant line may be connected, and wherein said first means comprises a first valve selectively operable to direct coolant alternatively between said radiator and said third flow path of said second heat exchanger.

11. The system of claim 10 wherein said second means comprise a second valve selectively operable to direct said heating water from said heater alternately between a direct connection to said second flow path of said first heat exchanger and connection to said fourth flow path of said second heat exchanger and thence to said second flow path of said first heat exchanger.

12. The system of claim 11 wherein said first and second valves are three-way valves.

13. The system of claim 9 wherein said other building is divided into first and second, enclosed compartments, said first compartment being positioned vertically above said second compartment, said first compartment housing said air handling equipment, said heater and said second engine and generator, and said second compartment housing said fabrication tooling.

14. The system of claim 9 wherein said fabrication tooling comprises photolithography equipment used in the fabrication of semiconductor components.

15. The system of claim 9 wherein said first and second means each include a three-way valve, and said second means further comprises a booster pump.

16. The method of protecting temperature-sensitive production tooling from potentially damaging low temperatures and rapid temperature drops, said method being employed in a manufacturing facility having:

a central utility plant housing at least one fluid-fired boiler with an electrically powered first pump for circulating water from said boiler to a first flow path of at least one, first heat exchanger when outside temperature is below a predetermined value, and a first internal combustion engine and generator for providing electrical power to said first pump when the latter is in use during periods of primary power outage, and one or more fabrication buildings each housing at least one of said first heat exchangers, a hot water radiation heater for flow of heating water through a second flow path of said first heat exchanger, electrically powered air handling equipment for exhausting air at a predetermined rate from and drawing outside air at substantially said predetermined rate into the associated one of said fabrication buildings, a second, liquid cooled, internal combustion and generator for providing electrical power to said air handling equipment during periods of primary power outage, and a heat rejecting radiator connected to receive hot coolant from and return cooled coolant to said second engine during periods of primary power outage when outside temperature is above said predetermined level, said method comprising:

a) providing a second heat exchanger having third and fourth flow paths in each of said fabrication buildings;

b) providing a first valve selectively operable to block flow of said coolant from said second engine to said radiator and directing said coolant through a first, alternate flow line to said third flow path;

c) providing a second valve selectively operable to block flow of said heating water to said second flow path and directing said heating water through a second, alternative flow line to said fourth flow path, whereby said heating water absorbs heat from said coolant in said second heat exchanger;

d) providing a third flow line connected to direct said heating water from said fourth flow path to said second flow path, whereby said heating water absorbs heat from said boiler heated water;

e) observing the temperature outside said fabrication buildings during periods of primary power outage; and f) actuating both of said first and second valves when the observed temperature is below said predetermined value.

17. The method of claim 16 wherein said first and second valves are three-way valves.

18. The method of claim 16 and comprising the further steps of positioning a selectively operable booster pump in said third line and operating said booster pump only when said first and second valves are actuated.

19. The method of claim 16 wherein each of said fabrication buildings is divided into upper and lower, substantially exclusive compartments, and air is drawn by said air handling equipment into, and heated by said heater in said upper compartment for delivery to said lower compartment, said second engine and generator and said second heat exchanger are positioned in said upper compartment, said production tooling is positioned in said lower compartment, and said radiator is positioned outside said other building.

* * * * *

UNITED STATES PATENT AND TRADEMARK OFFICE

CERTIFICATE OF CORRECTION

PATENT NO. : 6,971,585 B2
DATED : December 6, 2005
INVENTOR(S) : Johnson, Roy P. et al.

It is certified that error appears in the above-identified patent and that said Letters Patent is hereby corrected as shown below:

Column 7,
Line 23, delete “though” and substitute -- through --;
Line 35, delete “said”, second occurrence.

Signed and Sealed this

Thirty-first Day of January, 2006

JON W. DUDAS
*Director of the United States Patent and Trademark Office*